United States Patent [19]

Lewis et al.

[11] 4,070,431

[45] Jan. 24, 1978

[54] IMPROVED YARN EXTRACTION PROCESS

[75] Inventors: Gary Brett Lewis; Stephen Donald Moore, both of Richmond, Va.

[73] Assignee: E. I. Du Pont de Nemours and Company, Wilmington, Del.

[21] Appl. No.: 752,913

[22] Filed: Dec. 21, 1976

[51] Int. Cl.[2] ..... D01D 5/14

[52] U.S. Cl. ..... 264/180; 264/181; 264/184; 425/71

[58] Field of Search ..... 264/180, 184, 181; 425/181, 184, 71

[56] References Cited

U.S. PATENT DOCUMENTS

| | | | |
|---|---|---|---|
| 3,940,955 | 3/1976 | Welsh | 68/20 |
| 3,996,321 | 12/1976 | Weinberger | 264/184 |

*Primary Examiner*—Jay H. Woo

[57] ABSTRACT

The salt content of neutralized aromatic polyamide fibers spun from an acid solution downwardly into a spin tube containing the fibers and a coagulating liquid is reduced when a gas is injected into the spin tube 0.25 to 20 cm. downstream from the entrance of the spin tube.

5 Claims, 3 Drawing Figures

IMPROVED YARN EXTRACTION PROCESS

BACKGROUND OF THE INVENTION

Wet spinning of an acid solution of an aromatic polyamide followed by neutralization of residual acid yields salts, e.g., sodium sulfate, in the fibers. The presence of salt in the fibers causes undesirable deposits on apparatus used for handling the fibers. Excessive amounts of salt in the fibers are also believed to interfere with adhesion of the fibers to rubber and various resins.

In commercial spinning processes, high speed operation is essential for economic practicability. Thus the time available for coagulating and washing of wet-spun fibers is extremely limited.

Since a small amount of the above-mentioned residual salt can be tolerated, improvements in the washing process can provide either a lower salt content in the fibers or a higher spinning speed at the same salt level.

The amount of salt present is proportional to the amount of residual acid present in the fibers at the time of neutralization. Thus any improvement in the efficiency of acid extraction will provide a decrease in residual salt content after neutralization.

SUMMARY OF THE INVENTION

The present invention provides for high speed, high efficiency washing of solvent-laden yarn moving through a process such as described in Blades U.S. Pat. No. 3,767,756.

The present invention provides more efficient extraction of residual acid in a wet spinning process using an acid solvent. The reduced amount of residual acid in the fibers provides a lower residual salt content and/or permits higher spinning speeds for more economical operation.

The present invention provides a process for spinning an acidic solution of an aromatic polyamide downwardly through a non-coagulating fluid into a liquid coagulating bath and subsequently through a spin tube through which some of the coagulating liquid passes along with the freshly spun fibers at a spinning speed of at least 300 mpm wherein 0.1 to 3 volumes of a gas per volume of coagulating liquid passing through the spin tube are injected into the spin tube at a point 0.25 to 20 cm. downstream from the entrance of the spin tube. Preferably the spinning speed is 450 to 650 mpm and 0.43 to 1 volumes of gas per volume of coagulating liquid are injected. Preferably the gas is injected at a point 2.5 to 20 cm. downstream from the entrance of the spin tube and the gas is air.

DETAILED DESCRIPTION OF THE PREFERRED EMBODIMENT

Figure 1:
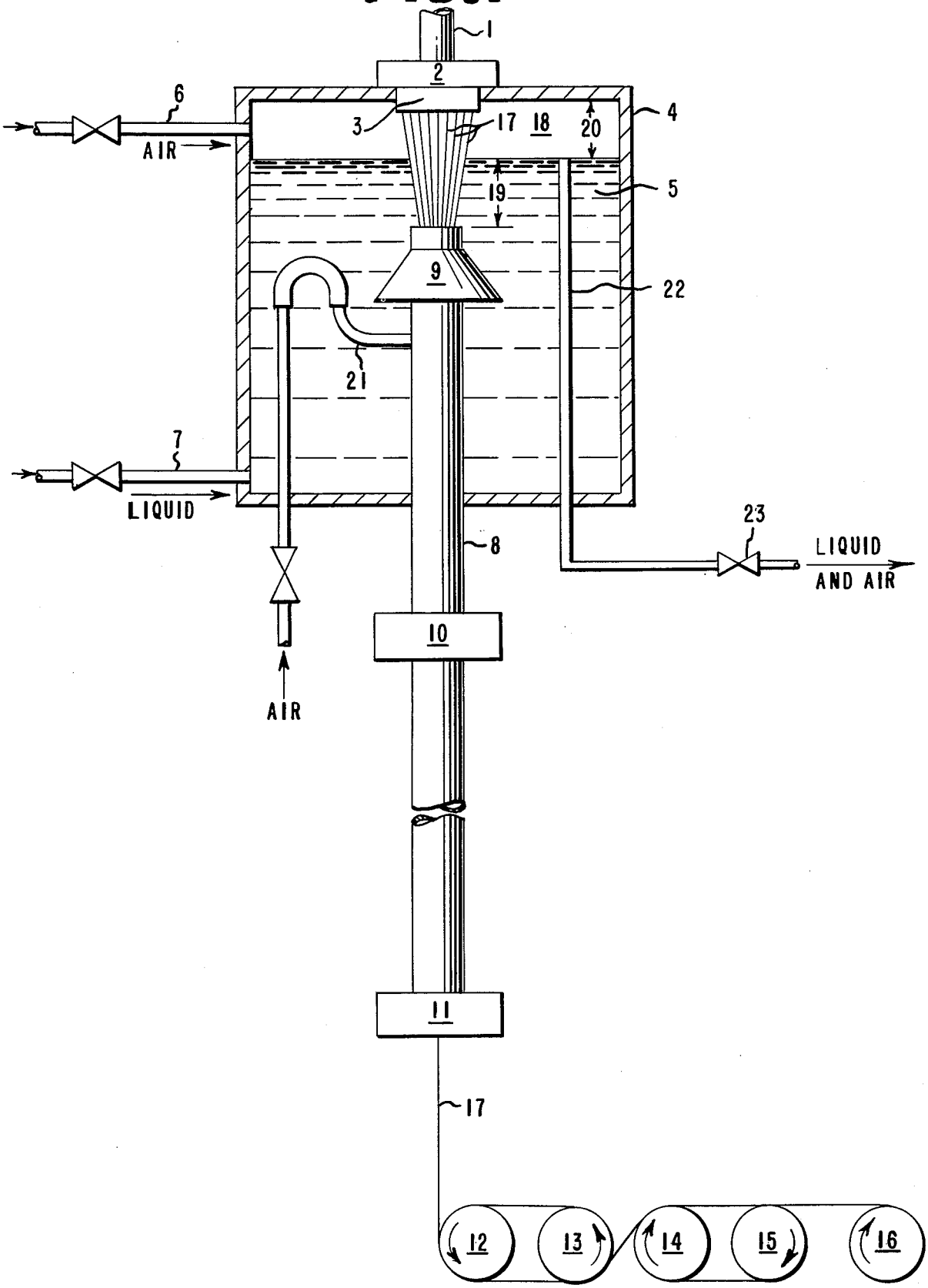
FIG. 1 shows apparatus suitable for carrying out the process of the present invention.

In FIG. 1, acid aromatic polyamide spinning dope is pumped through transfer line 1 to spinning block 2 then through spinneret 3 located above vessel 4 containing a liquid coagulating bath 5 supplied through pipe 7 and a layer of air 18 supplied by pipe 6. The coagulating bath level and pressure of air layer 18 are controlled by pipe 22 and valve 23. A spin tube 8 immersed in bath 5, extends through the bottom of vessel 4 and connects with extraction and neutralization apparatus 10 which is connected to further extraction and neutralization apparatus 11. Extruded filaments 17 coming from spinneret 3 pass through air layer 18 then through coagulating liquid 5 which is flowing from vessel 4 through spin tube 8 along with filaments 17. The top of spin tube 8 may be fitted with a deflector 9 which aids in the circulation of the coagulating liquid 5 in vessel 4. Air or another gas under pressure is inserted through pipe 21 into a manifold 24 (see FIG. 3) through peripheral openings 25 at an appropriate distance from the entrance of spin tube 8. The filaments 17, coagulating liquid 5 and air pass into extraction and neutralization apparatus 10 wherein entrained coagulating liquid may be removed by an air jet before treatment of the filaments 17 with dilute caustic. The filaments 17 may be further processed by passing them through a tube to further extraction and neutralization apparatus 11 where entrained dilute caustic wash may be removed by air jets before the filaments are wound on driven roll 12 and associated separator roll 13 and sprayed with very dilute caustic solution. The filaments 17 then pass around heated rolls 14 and 15 for drying before being wound up on bobbin 16.

Figure 2:
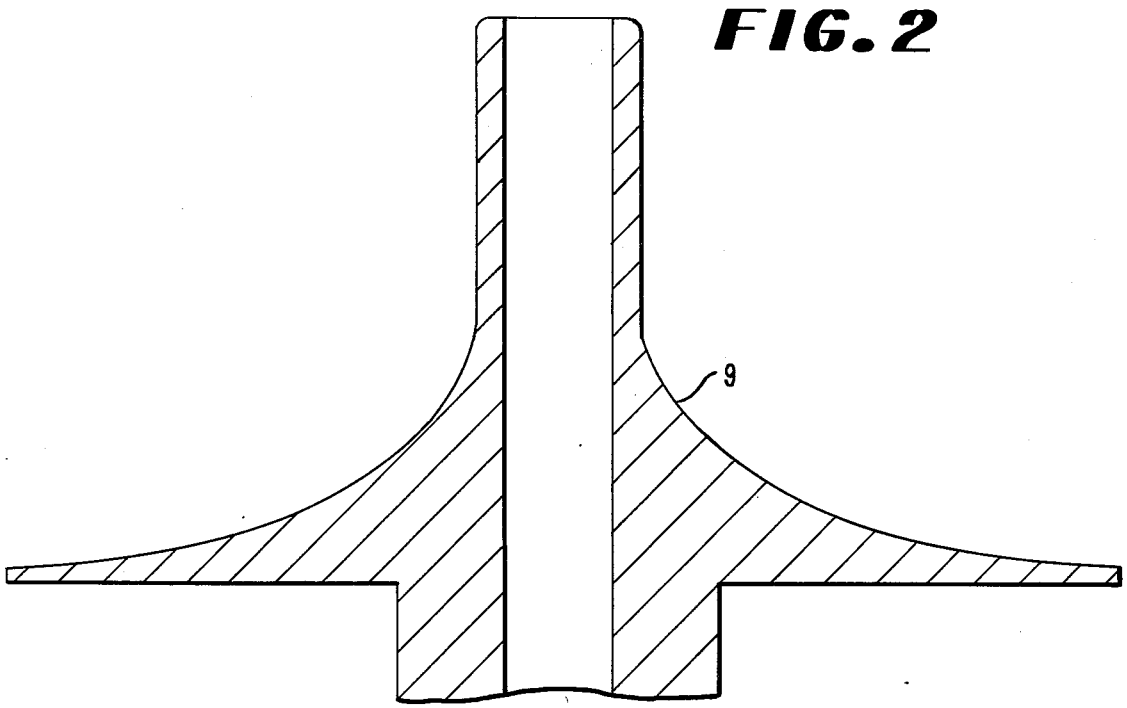
FIG. 2 shows the top of a spin tube which may be used without gas injection.

FIG. 2 shows a spin tube having straight walls which may be used for carrying out a spinning process which does not use air injection but is otherwise similar to the process shown in FIG. 1.

Figure 3:
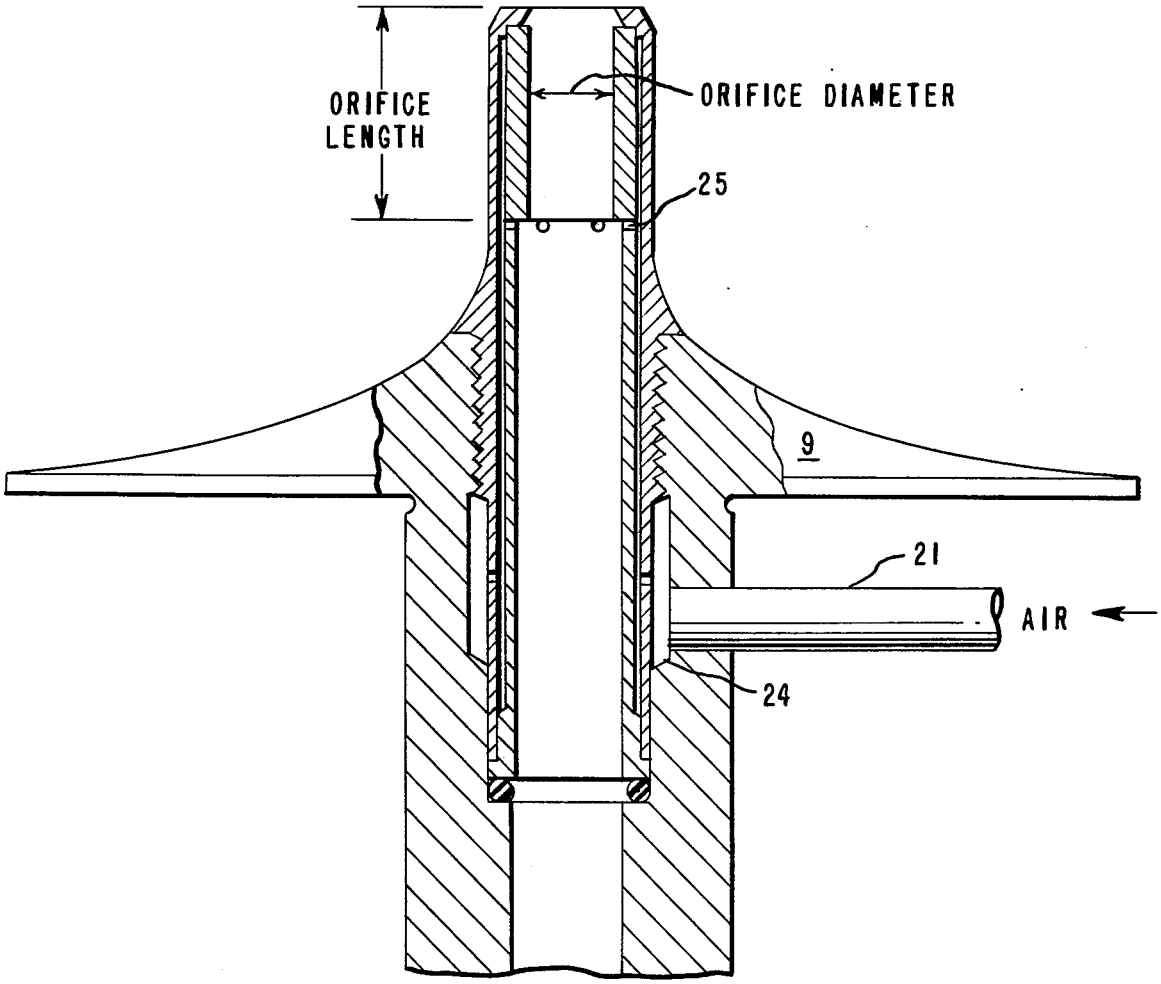
FIG. 3 shows a preferred configuration of the top of spin tube 8.

FIG. 3 shows the top of the preferred spin tube for use in the process of the invention along with the apparatus shown in FIG. 1.

Other arrangements for the injection of a gas into the spin tube may also be used. Significant salt reduction has been obtained with tubes having initial tube lengths of between 0.25 and 20 cm. before air injection.

It has been found that injection of a volume of gas amounting to at least 0.11 volume per volume of coagulating liquid flowing through the spin tube is required to significantly reduce the salt content of the fiber. Gas volumes 0.43 to 1 times the volume of coagulating liquid afford greater control over the process and volumes as high as 3 times the volume of coagulating liquid have been demonstrated with no detrimental effects.

The arrangement for injection of the gas is not critical and may be conveniently accomplished through 3 to 6 peripheral orifices in the wall of the spin tube fed by manifold 24 and pipe 21. A suitable air pressure is 130 to 280 kPa. absolute for a spin tube having an inside diameter of about 0.85 cm. at the point of air injection. About 11 to 23 standard liters per minute (20° C, 101 kPa) air is usual.

TEST PROCEDURES

The salt (i.e., $Na_2SO_4$) content of the dried yarn is obtained by ashing a dry sample, dissolving the ashes in HCl, diluting volumetrically and measuring $Na^+$ in an atomic absorbing spectrophotometer. The weight percent $Na_2SO_4$ present in the yarn (as calculated from the total $Na^+$) is corrected for any $Na^+$ present in the initial polymer.

Fiber properties are measured at 24° C and 55% relative humidity on yarns that have been conditioned at 24° C and 55% relative humidity for a minimum of 14 hours. The nominal 1500 denier yarns of the examples are given about 0.8 turns twist/cm. (i.e. 1.1 twist multiplier) and broken with a 25.4 cm. gage length at 50% strain rate/minute. Deniers are obtained by weighing a known length of yarn and corrected to a finish-free basis containing 4.5% moisture.

EXAMPLES

General Procedure

A 19.3% by weight solution of poly(p-phenylene terephthalamide) having an inherent viscosity of 5.4 ($H_2SO_4$) in 100% sulfuric acid is extruded at 75° C from a spinneret containing 1000 holes through a layer of air into the coagulating liquid (water, 25° C) using the apparatus of FIG. 1. The coagulated filaments are carried through the water in the spin tube for about 0.3 seconds (2.7 m.) before the liquid is removed by air jets. The bundle of filaments is then impinged with streams of a dilute (1%) aqueous solution of sodium hydroxide and the yarn advanced in contact with the sodium hydroxide solution in a tube for approximately 0.73 second (6.7 m.) before the liquid is removed by air jets. The yarn is then sprayed with a very dilute aqueous solution of sodium hydroxide (0.05% by weight) while passing from a driven feed roll to an idler roll with multiple wraps. The yarn (nominal 1500 denier) is then passed over drying rolls into a package at 549 meters/minute.

EXAMPLE 1

A. (Control) The above procedure is followed using the spin tube of FIG. 2 (inside diameter 8.6 mm.) with an air gap of 6 mm. as measured vertically from the spinneret face to the upper level of the quench liquid (before the vortex) and a stagnant layer of 38 mm. "Stagnant layer" is the vertical distance (19 in FIG. 1) from the top of the spin tube to the upper surface of the quench liquid (before the vortex). The coagulating liquid flows from the bath through the tube at a rate of 23 to 27 liters/minute. Properties of the dried yarn are given in Table I.

B. The above general procedure is followed after completing part A using the same spinning solution with three different spin tubes of FIG. 3 having an entrance inside diameter of 6.86 mm., an inside diameter of the following part of the tube of 7.11 mm. and lengths of 2.5, 15, and 28 mm., respectively, before expansion to a continuing tube inside diameter of 8.64 mm. immediately followed by the air injection holes. Air from a 580 kilo Pascal (kPa) (85 lbs./sq. in. absolute) source and a valve and rotameter is delivered at the rate of 11.3 L./min. (20° C and 101 kPa) through the air injection holes. A coagulating liquid flow of 13 l./min. of water was used with an air gap of 6 mm., a stagnant layer of 25 mm. and a pressure of 120 kPa in the air gap. Average properties of the dry yarn from the three different tubes are given in Table I. The air injected amounts to 0.87 volumes per volume of coagulating liquid (water and air at 20° C and 101 kPa).

Similar results are obtained using initial tube lengths of up to 20 cm. in length before the air injection. The minimum air injection in order to be able to control the air gap and stagnant layer independently, amounted to 0.5 and 0.61 volumes air per volume coagulating liquid, respectively, for 5 and 20 cm. initial tube lengths.

EXAMPLE 2

A. (Control) The procedure of Example 1 A is followed with an air gap of 9 mm., a stagnant layer of 35 mm. and a coagulating liquid flow of 23 to 27 L./min. Fiber properties are given in Table I.

B. The spin tube of FIG. 3 is used having an entrance inside diameter of 6.35 mm, following tube inside diameter of 7.11 mm. and a tube length of 100 mm. before the tube is expanded to a continuing inside diameter of 8.64 mm., immediately followed by the air injection holes (6 holes of 1.2 mm. diameter equally spaced on the circumference of the tube). A coagulating liquid flow of 13 L./min., an air gap of 8 mm., a stagnant layer of 25 mm. and an air flow of 16 L./min. (20° C and 101 kPa) were used. Properties are given in Table I. The air flow was 1.23 volumes per volume of the coagulating liquid (water and air at 20° C and 101 kPa).

TABLE I

| Example | Yarn Tenacity/ Elongation/ Initial Modulus | % Salt | Volume Air/ Volume Coagulating Liquid |
|---|---|---|---|
| 1A | 21.0 gpd./3.8%/490 gpd. | 2.0 | 0 |
| 1B | 21.0 gpd./4.0%/470 gpd. | 1.6 | .87 |
| 2A | 21.8 gpd./3.7%/510 gpd. | 1.9 | 0 |
| 2B | 22.2 gpd./3.8%/500 gpd. | 1.6 | 1.23 |

What is claimed is:

1. A process for spinning an acidic solution of an aromatic polyamide downwardly through a non-coagulating fluid into a liquid coagulating bath and subsequently through a spin tube through which some of the coagulating liquid passes along with the freshly spun fibers at a spinning speed of at least 300 mpm wherein 0.1 to 3 volumes of a gas per volume of coagulating liquid passing through the spin tube are injected into the spin tube at a point 0.25 to 20 cm. downstream from the entrance of the spin tube.

2. Process of claim 1 wherein the spinning speed is 450–650 mpm.

3. Process of claim 1 wherein 0.43 to 1 volumes of gas per volume of coagulating liquid are injected.

4. Process of claim 1 wherein the gas is injected at a point 2.5 to 20 cm. downstream from the entrance of the spin tube.

5. Process of claim 1 wherein the gas is air.

* * * * *